US007073232B1

(12) United States Patent
Fuhrman et al.

(10) Patent No.: US 7,073,232 B1
(45) Date of Patent: Jul. 11, 2006

(54) MAGNETIC JEWELRY CLASP WITH SAFETY CATCH

(76) Inventors: Esther C. Fuhrman, 600 Harbor Blvd., Weehawken, NJ (US) 07086; Robert J. Fuhrman, 600 Harbor Blvd., Weehawken, NJ (US) 07086

( * ) Notice: Subject to any disclaimer, the term of this patent is extended or adjusted under 35 U.S.C. 154(b) by 0 days.

(21) Appl. No.: 10/625,030

(22) Filed: Jul. 22, 2003

Related U.S. Application Data

(60) Provisional application No. 60/398,353, filed on Jul. 22, 2002, provisional application No. 60/410,760, filed on Sep. 13, 2002, provisional application No. 60/448,027, filed on Feb. 18, 2003.

(51) Int. Cl.
*A44B 21/00* (2006.01)
*A44C 11/02* (2006.01)

(52) U.S. Cl. ..... 24/303

(58) Field of Classification Search ..... 24/303
See application file for complete search history.

(56) References Cited

U.S. PATENT DOCUMENTS

| | | | | | |
|---|---|---|---|---|---|
| 1,441,999 | A | | 1/1923 | Posner | |
| 1,807,293 | A | | 5/1931 | Keller | |
| 2,654,929 | A | * | 10/1953 | Feibelman | 24/303 |
| 3,177,546 | A | * | 4/1965 | Bey | 24/303 |
| 4,622,726 | A | * | 11/1986 | Nakamura | 24/303 |
| 5,008,984 | A | | 4/1991 | Levy | |
| 5,050,276 | A | * | 9/1991 | Pemberton | 24/303 |
| 5,197,168 | A | | 3/1993 | Levy | |
| 5,311,647 | A | | 5/1994 | Levy | |
| 5,317,789 | A | | 6/1994 | Levy | |
| 5,349,725 | A | | 9/1994 | Levy | |
| 5,367,891 | A | | 11/1994 | Furuyama | |
| 5,572,887 | A | * | 11/1996 | Geswelli | 24/303 |
| 5,664,298 | A | | 9/1997 | Nessar-Ivanovic | |
| 6,481,065 | B1 | * | 11/2002 | Cogdill | 24/303 |
| 6,505,385 | B1 | * | 1/2003 | Grunberger | 24/303 |
| 6,591,462 | B1 | | 7/2003 | Fuhrman | |
| 6,640,398 | B1 | * | 11/2003 | Hoffman | 24/303 |

FOREIGN PATENT DOCUMENTS

EP 462072 A1 12/1991

* cited by examiner

*Primary Examiner*—Robert J. Sandy
(74) *Attorney, Agent, or Firm*—Stephen E. Feldman PC; Stephen E. Feldman; Matthew T. Dennehy

(57) ABSTRACT

A jewelry clasp having a pair of bodies at the free ends of a piece of jewelry affixed together by magnetic forces. Each body has a magnet means having north and south poles that are aligned along the longitudinal center line of the clasp with opposite poles abutting each other to hold those bodies in the affixed relationship. There is a safety catch on one of the bodies having a protrusion extending therefrom that overlaps the other body to hold the bodies together. As the protrusion is moved into its latched position, the other body is displaced along the longitudinal centerline to misalign the respective magnetic means, and when the protrusion seats in its latched position, the magnetic means realigns by the magnetic attraction between the magnetic means creating an click that can be heard and/or felt by the wearer to confirm that the bodies are properly affixed together.

18 Claims, 8 Drawing Sheets

MAGNETIC JEWELRY CLASP WITH SAFETY CATCH

REFERENCE TO RELATED CASES

The present application claims priority from Provisional Application Ser. No. 60/398,353 filed Jul. 22, 2002 and entitled MAGNETIC JEWELRY CLASP WITH SAFETY CATCH and claims priority from Provisional Application Ser. No. 60/410,760 filed Sep. 13, 2002 and entitled MAGNETIC ALIGNMENT ADVANTAGES and claims priority from Provisional Application Ser. No. 60/448,027 filed Feb. 18, 2003 and entitled MAGNETIC JEWELRY CLASP.

BACKGROUND OF THE INVENTION

The present invention relates to jewelry and, more particularly, to an improved clasp for joining the two free ends of a jewelry chain together in an easy to facilitate junction.

With certain jewelry, particularly women's jewelry, there is an inherent conflict between the need to make the clasp easy to facilitate so that the wearer can readily attach and detach the free ends of the bracelet or necklace, and the need to make the clasp very secure so that it does not readily and inadvertently become unattached and risk the potential loss of the jewelry.

Thus, even young people, having a great deal of dexterity, find it difficult to fasten necklaces behind their necks or fasten most bracelets which, by their nature, must be fastened with the use of only one hand. This problem is compounded many fold in the case of older people or the many millions of people who suffer from even mild cases of arthritis or similar afflictions that limit the use of the hands.

Magnetic clasps, without safety catches, are widely used for costume jewelry. However, manufacturers and retailers of fine jewelry (gold jewelry, sterling silver jewelry or jewelry containing gemstones) seldom, if ever, offer necklaces with magnetic clasps. Makers and wearers of fine jewelry want the security of a safety catch and none of the available magnetic clasps with safety catches are considered practical. Such clasps are either too difficult to close, not secure when closed or are too difficult to open. In addition some are simply not attractive.

Accordingly, the clasp for jewelry, as well as clasps for other items, have a long felt need to meet all three of the key consumer requirements, that is, the clasp must be easy attach and detach, it must be secure when closed (can't be opened by pulling it apart) and it must be easy to open. In addition to those functional requirements, of course, the clasp is commercially benefited by being attractive so that the clasp enhances, rather than detracts, from the overall attractive appearance of the jewelry itself.

An example of a magnetic clasp is shown and described in U.S. Pat. No. 3,664,298 of Nessar-lvanovic where there is a clasp having side by side magnets that are laterally spaced apart about the centerline of the clasp parts and wherein the joining of the parts in making up the clasp requires an interlocking of the two parts by means of a specially configured socket arrangement. That interlocking arrangement would appear to require some dexterity on the part of the wearer and the overall clasp would seem susceptible to opening upon receiving a pulling force in a direction diagonal to the end edges of the clasp.

It would, therefore, be advantageous for a clasp to have all of the foregoing attributes and, additionally provide some positive indication to the wearer that the clasp has been effectively and fully closed and one means of providing such positive indication would be to have positive clicking action that the wearer could hear and/or feel, to indicate to the wearer that the clasp has been fully closed and the danger of a partially closed clasp inadvertently coming apart is basically eliminated.

Accordingly, it would be advantageous to have a clasp for joining the free ends of a piece of jewelry having features that overcome the aforedescribed shortcomings in present clasps while having the desired functional features and, at the same time, providing an attractive appearance to the wearer.

SUMMARY OF THE INVENTION

The present invention relates to an improved clasp for jewelry, as well as other items, that is easy to close and where that closure is secure to protect the item of jewelry and wherein the clasp is also easy to open so that the clasp satisfies the long felt need for such a clasp as previously described.

In the present clasp, there are two bodies that are affixed to the free ends of a necklace or bracelet and which are joined together to make up the clasp of the present invention. Each of the bodies has a magnetic means forming a magnetically attractive surface that has both a north pole and a south pole. In carrying out the affixation of the bodies, the magnetically attractive surfaces are located abutting each other with the north pole of one magnetically attractive surface aligned with the south pole of the other magnetically attractive surface such that the bodies are forcefully held together by the mutual magnetic attraction of the opposite polarity magnetic poles of the respective bodies aligned against each other.

The respective poles of the magnetic means on each body is aligned along a longitudinal centerline through the body and which basically follows the line between the chain that is affixed to the clasp and which makes up the article of jewelry.

There is also a safety catch that is mounted to one of the bodies and which can be pivotally affixed thereto and which can be moved between an unlatched position and a latched position where the free end of the safety catch interfits with the other body, thereby providing a safety catch to prevent the bodies from coming apart.

In one embodiment, the safety catch has a protrusion that enters into a bore formed in the other body to latch the two bodies firmly together and, in an alternative embodiment, there can be a protrusion having an inwardly directed lip at the free end thereof that overlaps the other body to create the secure latching of the bodies.

In a another embodiment, there is a first body and a second body having the pivotally affixed safety latch with the protrusion having a inwardly directed lip formed at the free end and the first body is shorter than the second body. As such, as the safety latch is pivoted to the latched position where the lip of the protrusion overlaps the first body, the lip initially engages the first body and causes it to move along the longitudinal centerline formed between the poles of the magnetic means so that the magnetic means are slightly displaced and the north and south poles misaligned.

As the safety latch continues to the latched position, the lip passes over the end of the first body freeing the first body to rapidly return to its position where the magnetic means are again aligned. That rapid movement of the magnetic means of the first body creates a click that can be felt and/or heard by the wearer and provides a positive indication to the wearer that the clasp has been fully closed and the safety latch engaged so that the wearer can be assured the piece of jewelry is safely affixed to the wearer.

Accordingly, with the clasp of the present invention, the necklace or bracelet can readily be joined together by the wearer with one hand and, since the bipolar magnetic means aligns the magnetic poles along a straight line as if they were an extension of the bracelet or necklace, the only way the bodies can come together is in the correct alignment with the north pole of one magnetic means aligned with the south pole of the other magnetic means. The clasp will, therefore, always be correctly and exactly aligned and which not only makes the clasp more attractive but the magnetic attraction also makes it easier to fasten the safety catch since the wearer only needs to squeeze the clasp between the fingers until a click is felt and/or heard by the wearer.

On the other hand, when the safety catch is in its latched position the jewelry is very secure and if some one attempts to pull the bodies apart by pulling on the two ends of the necklace or bracelet, the clasp will sustain a considerable amount of force and, in most cases, the jewelry itself will come apart at some other location before the clasp is detached. It would be virtually impossible for the clasp to come loose by accident or by getting caught on something.

Yet, the present clasp is easy to open and can be opened with one hand without looking. In addition, due to the ability to incorporate the present clasp into a very flat, non bulky, configuration, the clasp is attractive to wear and which is a desirable feature from a cosmetic standpoint. Since the clasp has the respective magnetic means of the two bodies automatically aligned in the same direction i.e. the longitudinal centerline, as the neck chain or bracelet, the clasp can be made to be very thin to appear attractive with a very thin neck chain or bracelet.

Additionally, there are no protuberances or safety catches that have edges that can dig into the skin of the wearer and the overall clasp can be quite versatile and can be made very thin and narrow to go with dainty, fine jewelry or can be constructed in a large, wide version that may be more acceptable for someone with arthritis of the fingers and has difficulty dealing with small clasps.

These and other features and advantages of the present invention will become more readily apparent during the following detailed description taken in conjunction with the drawings herein.

DETAILED DESCRIPTION OF THE INVENTION

Figure 1:
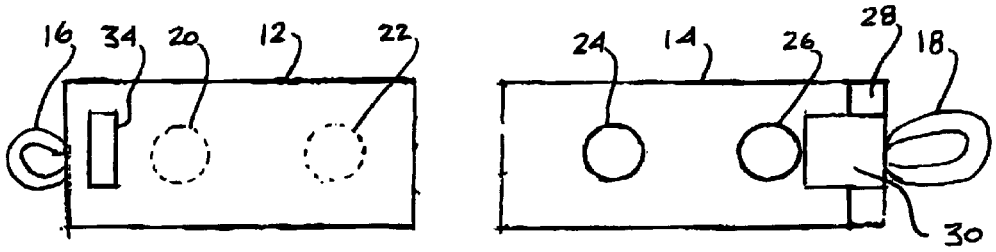
FIG. 1 is a top view of the two bodies that make up the jewelry clasp of the present invention.
Figure 2:
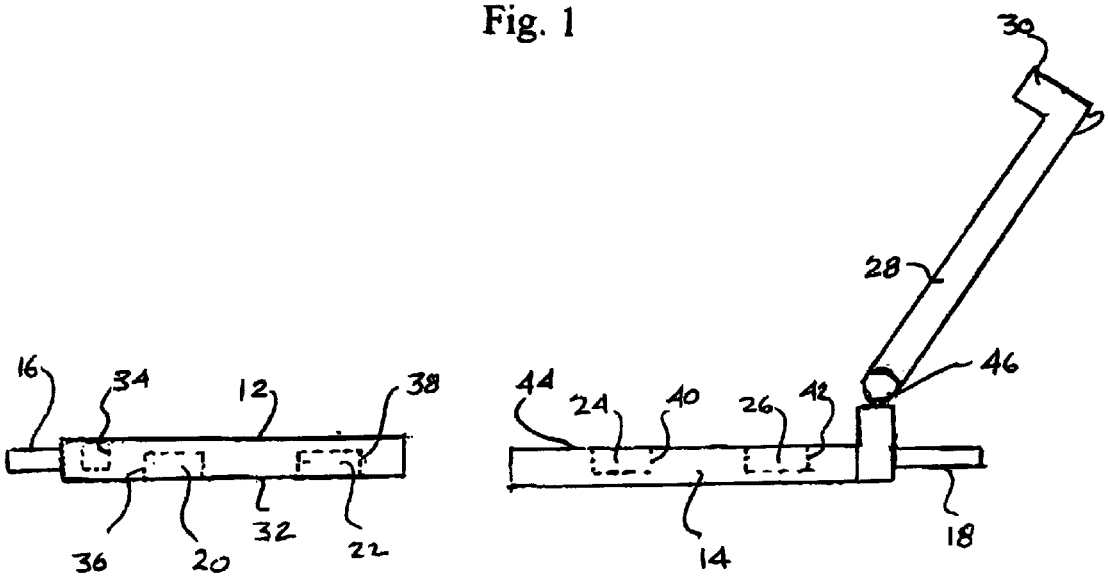
FIG. 2 is a side view of the bodies of FIG. 1.

Referring now to FIGS. 1 and 2, there is shown a top view of the two bodies 12, 14 that make up the jewelry clasp of the present invention. The bodies 12, 14 can be made of many materials, preferable of the metal material, such as silver or gold, that is the same as the material used in the piece of jewelry on which the clasp is being used. Both bodies 12, 14 have a ring 16, 18 respectively, that is used to affix the clasp to a jewelry chain, in conventional manner, that makes up the bracelet, necklace or other item.

As also can be seen, there is a magnetic means embedded or affixed to each of the bodies 12, 14 and the magnetic means comprises magnets 20, 22, 24 and 26 that are interfitted into suitable shaped recesses formed in the bodies 12, 14, to be later explained. The magnets are arranged, spaced apart along a longitudinal line extending between the magnets and the polarity of each of the magnets 20, 22, 24, and 26 is predetermined as will also be explained.

There is also a safety catch 28 that is pivotally affixed to the body 14 and that safety catch 28 has a protuberance 30 extending outwardly from the free end of the safety catch 28, preferable at about a right angle with respect to the safety catch 28.

Turning now to FIG. 2, there is shown a side view of the bodies 12, 14 and illustrating the orientation and location of the magnets 20, 22, 24 and 26. Thus, in FIG. 2 the magnets 20 and 22 of body 12, for example, are aligned to form a magnetically attractive surface 32 and which surface is a generally flat, planar surface. As to the polarity of the magnets 20, 22, the magnet 20 may have its north pole in alignment or flush with the magnetically attractive surface 32 while magnet 22 can have its south pole aligned or flush with that magnetically attractive surface 32. Thus, along the flat, planar magnetically attractive surface 32, there are two magnets, each having the opposite pole located flush or in alignment with that magnetically attractive surface 32.

Figure 3:
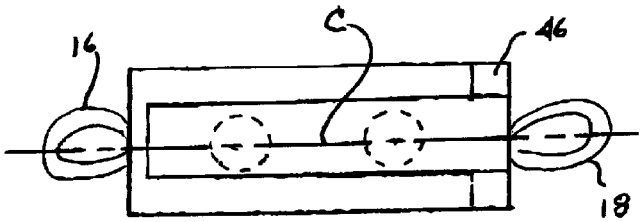
FIG. 3 is a top view of the completed clasp of the FIG. 1 embodiment.

As can also be seen, the orientation of the magnets within each of the bodies 12, 14 is such that the poles of the magnets are located along a longitudinal centerline of those bodies 12, 14, that is, the longitudinal centerline, shown as C on FIG. 3 and which extends longitudinally along the clasp from one ring 16 to the other ring 18 and generally in alignment with the chain or other flexible member that is affixed to the rings 16, 18 making up the necklace, bracelet or other article.

As another feature of the body 12, there is an indentation 34 located in the surface remote from the magnetically attractive surface 32. The magnets 20, 22 are embedded in the body 12 by fitting into a pair of recesses 36, 38 formed in the body 12. The magnets 20, 22 may be adhesively secured within the recesses 36, 38 or may be secured there by an affixation method to be later described.

With respect to the body 14, a similar arrangement is present, that is, the magnets 24, 26 are secured within recesses 40, 42 to form the flat, planar magnetically attractive surface 44 in the body 14. In this case, however, the magnet 24 has its south pole aligned or flush with the magnetically attractive surface 44 and the magnet 26 has its north pole aligned or flush with that magnetically attractive surface. The safety catch 28 can be seen to be pivotally affixed to the body 14 by means of the pivot 46 and thus the protuberance 30 is located at the free end of that safety catch 28 and can be moved from its unlatched position illustrated in FIG. 2 to a latched position engaging the body 12 as will be seen.

Figure 4:
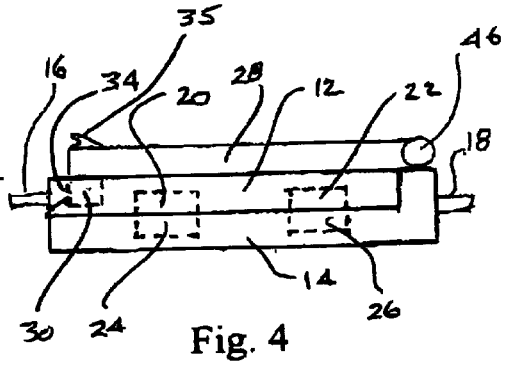
FIG. 4 is a side view of the completed clasp of FIG. 3.
Figure 5:
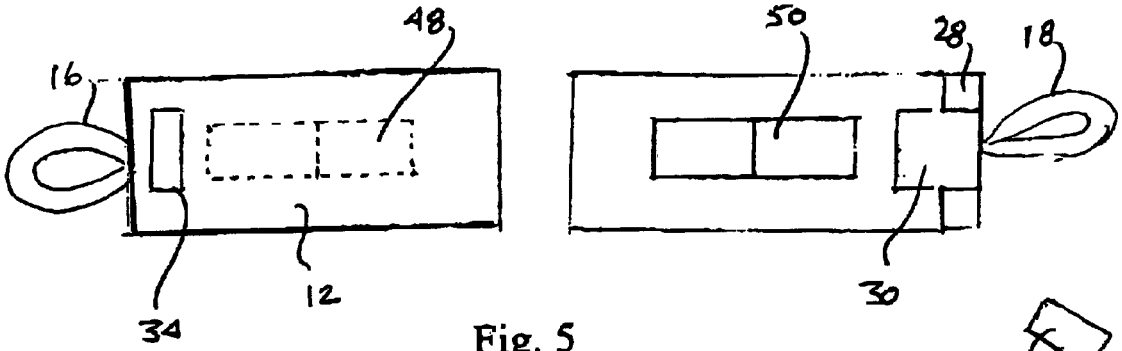
FIG. 5 is a top view of an alternative embodiment of a clasp to join two bodies of the present invention.
Figure 6:
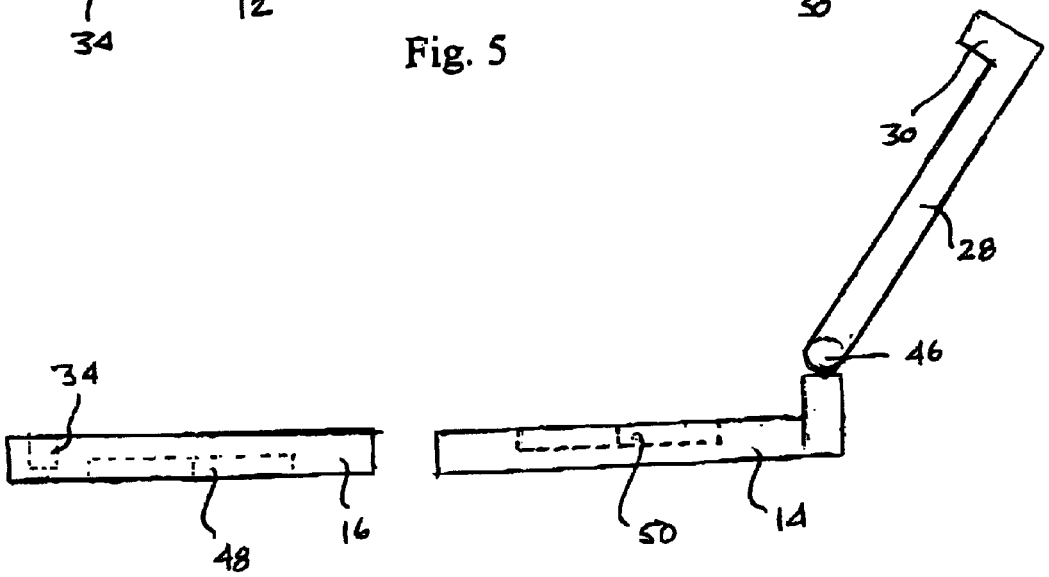
FIG. 6 is a side view of the bodies of the FIG. 5 embodiment.
Figure 7:
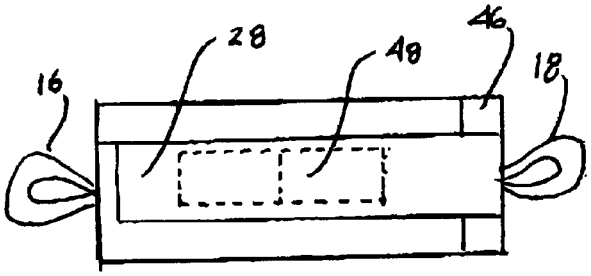
FIG. 7 is a top view of the completed clasp of the FIG. 5 embodiment.
Figure 8:
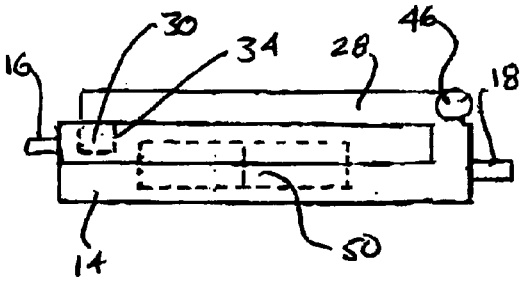
FIG. 8 is a side view of the completed clasp of FIG. 7.

Turning now to FIGS. 3 and 4, there is shown a top view and a side view, respectively, of the completed jewelry clasp of the present invention and showing the safety catch 28 in its latched position where the protuberance 30 has entered into and become affixed in the indentation 34 to retain the bodies 12, 14 firmly together.

As also can be seen, particularly in FIG. 4, the magnets 20, 22, 24 and 26 have become aligned with each other and the magnetically attractive surfaces 32 and 44 are in abutting relationship and are held together by the magnetic attraction of the magnets 20, 22, 24 and 26 since the south pole of magnet 24 is directly abutting and aligned with the north pole of magnet 20 and, likewise, the north pole of magnet 26 is aligned and contacting the south pole of magnet 22, thus, in each instance, the magnetically attractive surfaces 32, 44 are attracted to each other by the mating of the opposite poles of the individual magnets.

The magnets 20, 22, 24, and 26, as well as the other magnets described herein with respect to other embodiments of the invention, can be bi-polar rare-earth neodymium magnets, sintered, N45 strength, with strongest magnetic power through the thickness and such magnets have the strongest magnetic power for their size of any known current magnet, however, magnets with lesser power can perform effectively in the present clasp design. The magnets are preferably nickel plated to improve the appearance and prevent surface abrasion or corrosion.

Accordingly, as can be seen with respect to FIGS. 1–4, the clasp is easy to use in connecting the two bodies 12, 14 since the respective magnets of each body 12, 14 are spaced apart along the longitudinal axis or centerline of the clasp and in line with the chain of the particular jewelry and therefore the mutual magnetic attraction of the magnets brings about a perfect alignment of the bodies 12, 14 and the safety catch 28 can then be moved to its latched position and is assured of also being correctly aligned for the protuberance 30 to enter into and fit within the indentation 34.

The release of the clasp freeing the bodies 12 and 14 is also readily accomplished and can be carried out with the use of only one hand. After the safety catch 28 is returned to its unlatched position from its latched position, the bodies 12, 14 are simply pulled apart from each other in opposite directions, such that the magnetic attraction is readily dissipated, and the bodies 12, 14 easily come apart. In order to facilitate the engagement of the safety catch 28 by a wearer, there may be a ball or projection 35 formed on the safety catch 28 to enable the wearer to use a fingernail to easily carry out the movement of the safety catch 28.

Turning now to FIGS. 5–8, there is shown corresponding views as explained with respect to FIGS. 1–4 but in this embodiment, there are single multiple polar bar magnets 48 and 50 used instead of the individual magnets of the prior embodiment. The use of the magnetic means of the magnetically attractive surfaces 32, 44, however, is basically the same as described with respect to the prior embodiment of FIGS. 1–4 since the bar magnets 48, 50 each have a north pole and a south pole and are oriented such that the orientation of the poles of the bar magnets 48, 50 will, in FIG. 8, align, respectively, with the south pole and north pole of the bar magnet 50. In addition, of course, there needs to be only one recess 52, 54 in each of the bodies 12, 14 within which the bar magnets 48, 50 are affixed. It has been found that an advantage of the single multiple polar bar magnets is in their ease of assembly and the need for less assembly area in the construction of a clasp of the present invention.

In other respects, the embodiment of FIGS. 5–8 is the same as the embodiment of FIGS. 1–4, that is, the orientation of the poles of the bar magnets are also along the longitudinal centerline of the bodies and the magnetically attractive surfaces are flat, planar surfaces with the magnets themselves located in recesses therein. As an alternative, the magnets may themselves be flat, planar and may be surface mounted rather that recessed into the bodies providing the ultimate magnetically attractive surfaces remain as flat, planar surfaces.

Figure 9:
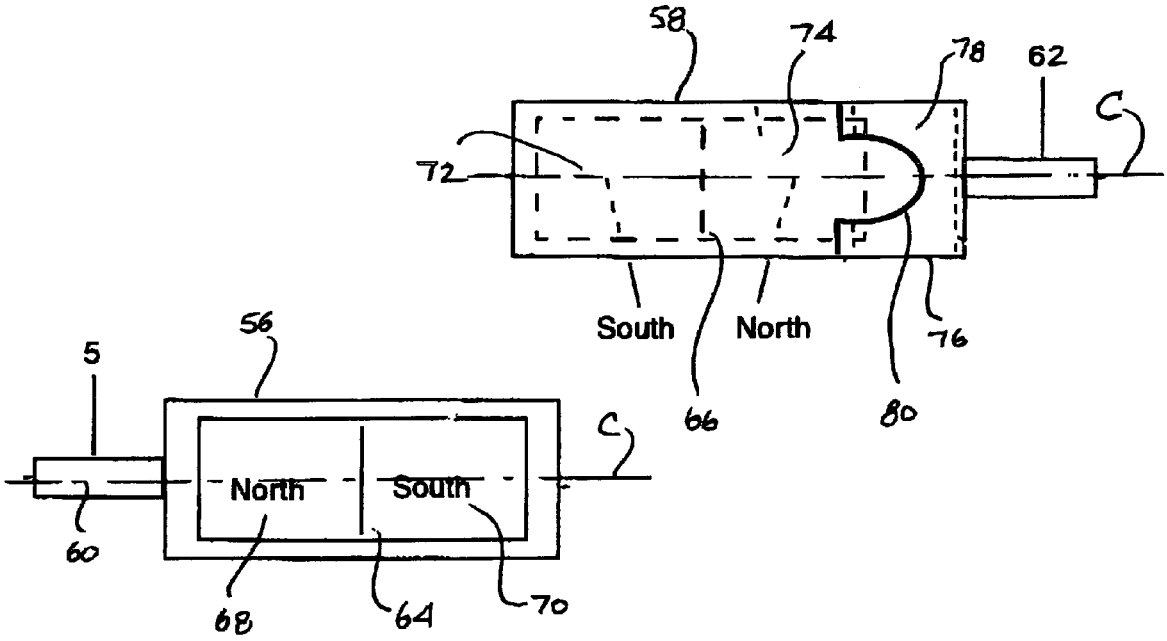
FIG. 9 is a top view of a still further embodiment of the present invention.

Turning now to FIG. 9, there is shown a top view of a still further embodiment of the present invention. Again, therefore, there is a first body 56 and a second body 58 each having a ring 60, 62 for attachment to the particular chain of the jewelry. In this embodiment there are again used, single multiple polar bar magnets 64, 66 with the bar magnet 64 having a north pole 68 and a south pole 70 and with the bar magnet 66 also having a south pole 72 and a north pole 74 both of which are oriented so that the poles of each bar magnet 64, 66 is on the longitudinal centerline of the first and second bodies 56, 58.

As can be seen, in the alignment of FIG. 9, and in the orientation when the first body 56 and the second body 58 are joined together, the north pole 68 and south pole 70 of the first body 56 will be aligned, respectively, with the south pole 72 and the north pole 74 of the second body 58 such that there will be a magnetic attraction between the respective bar magnets 64, 66 to pull and retain the first and second bodies 56, 58 together.

Again, as with the prior embodiments, there is a safety catch 76 having a protuberance 78 extending outwardly from the free end thereof at about a right angle. The protuberance 78 also has an arcuate recess 80 to avoid contacting the ring 60 when the safety catch 76 is moved from its unlatched position of FIG. 1 to its latched position as will later become clear.

Figure 10:
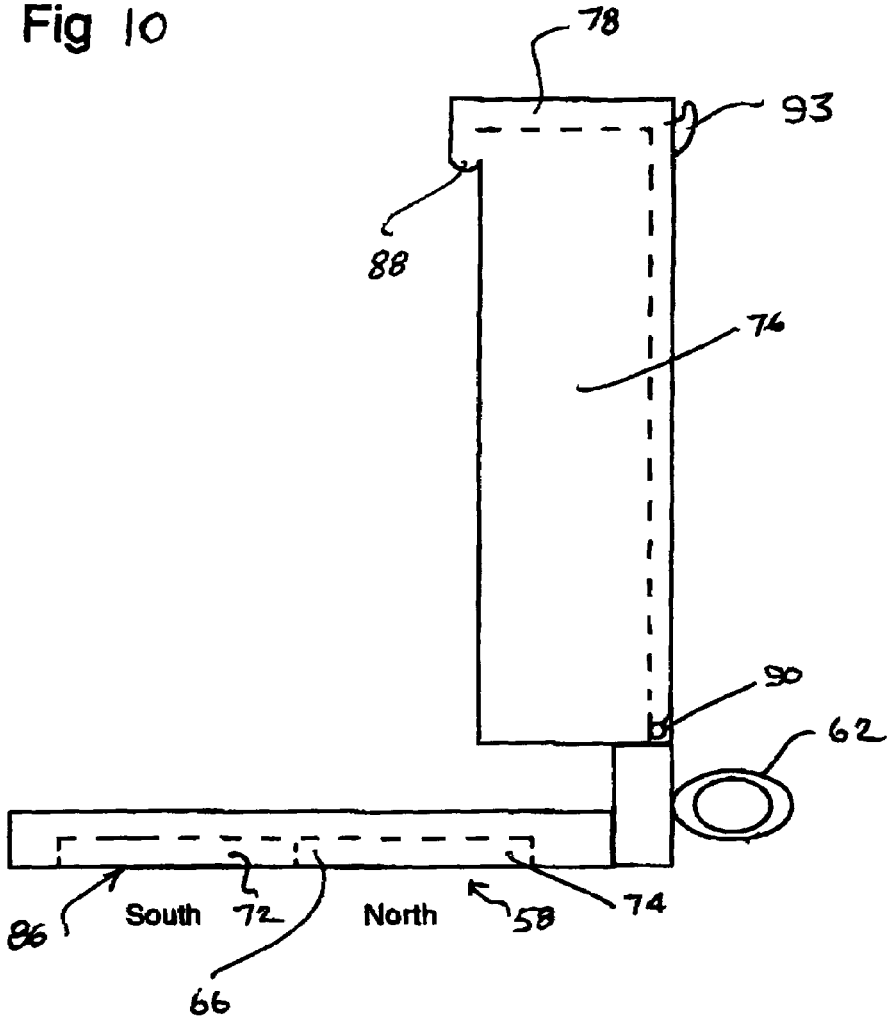
FIG. 10 is a side, exploded view of the bodies of the alternative embodiment of FIG. 9.
Figure 10:
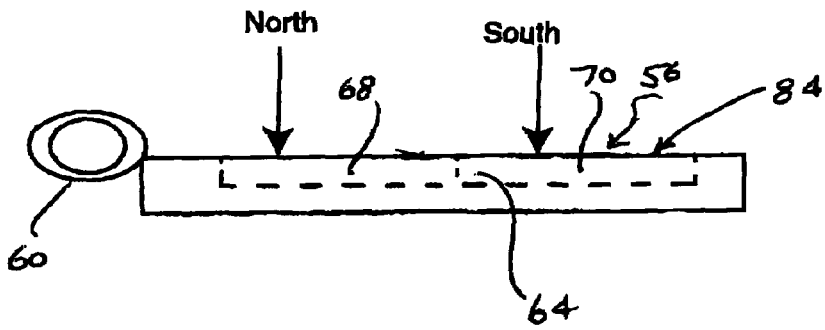

Turning now to FIG. 10, there is shown a side view of the clasp of the present invention. In this Fig., it can be seen the bar magnets 64 and 66 form the flat, planar, mating magnetically attractive surfaces 82, 84 respectively. Also, the safety catch 76 is shown to have a inwardly directed lip 88 at the distal end of the protuberance 78 and, in fact the inwardly directed lip 88 is a bifurcated lip that spans both sides of the ring 60 when the clasp is in the closed, latched position as a result of the arcuate recess 80 (FIG. 9). The safety catch 76 is pivotally affixed to the second body 58 at the pivot 90 to enable it to rotate between its latched and unlatched positions.

Figure 11:
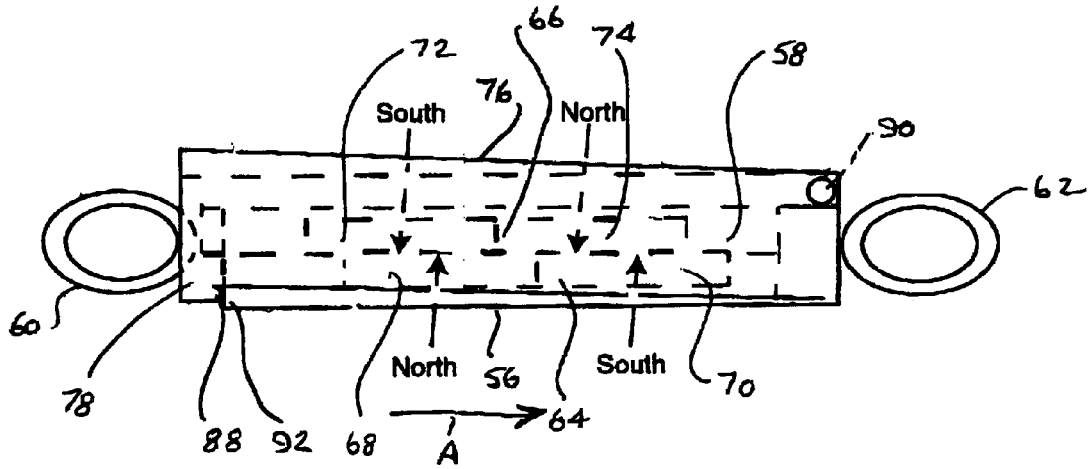
FIG. 11 is a side view of eh embodiment of FIG. 9 with the bodies in the process of closing together.

Turning now to FIG. 11, there is shown a side view of the clasp of the present invention where the safety catch 76 has been moved from its unlatched position of FIG. 10 to a point where it is almost in its latched position. In FIG. 11, therefore, it can be seen that the inwardly directed lip 88 engages the outer edge 92 of the first body 56 and causes that first body 56 to be displaced in the direction of the arrow A, away from their normal magnetically attracted aligned orientation thereby misaligning the respective bar magnets 64, 66 so that the magnetic attraction is lessened. That outer edge 92 can be formed to be located in the desired position by constructing the first body 56 to be slightly longer than the second body 58.

Figure 12:
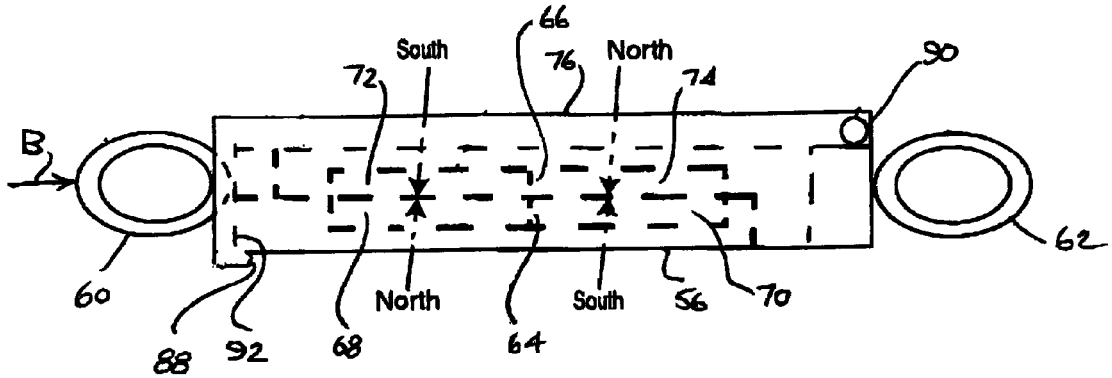
FIG. 12 is a side view of the FIG. 9 embodiment with the two bodies in the closed, latched position.

Therefore, in the final, latched position of the clasp as shown in the side view of FIG. 12, the inwardly directed lip 88 has passed over the outer edge 92 of the first body 56 and thereby frees the first body 56 to rapidly move, propelled by the mutual attraction of the bar magnets 64, 66, back to the aligned position where the poles of the respective bar magnets 64, 66 are again in perfect alignment and that rapid movement produces a click that can be heard and/or felt by the wearer.

Accordingly, the sound or feeling of the and/is a good, reassuring indication to the wearer that the clasp has been fully joined together and that the safety catch 76 is properly positioned in its latched position so that the wearer can be assured that the clasp is solidly affixed together and there is little danger of it being inadvertently separated with a potential loss of the jewelry.

With this embodiment, the detaching or separating of the clasp is readily accomplished by two quite different means. First, the clasp can be parted without even unlatching the safety catch 28. As can be seen in FIG. 12, while the first and second bodies 56, 58 cannot be pulled apart outwardly, since the inwardly directed lip 88 prevents that movement, however, the first and second bodies 56, 58 can be moved towards each other and thus create a misalignment of the magnetic means to allow the first and second bodies 56, 58 to be easily separated.

Therefore, if the wearer simply pushes on the ring 60 of the first body 56 in the direction of the arrow B, the first body 56 can be moved laterally, or along the longitudinal centerline C (FIG. 9) of the magnets to misalign the magnets. Once the inwardly directed lip 88 has been cleared, the first body 56 is free to be moved downwardly to separate it from the second body 58 since the magnetic attraction has been essentially eliminated. As such, the opening of the clasp can be accomplished with one hand without need for actual visual perception of the clasp.

As an alternate for opening the clasp, of course, the safety catch 76 can be moved for its latched position to its unlatched position by the user and the first and second bodies 56, 58 pulled apart. There may be a means to assist the wearer in engaging the safety catch 76 such as a ball or a projection 93 on the safety catch 76 to assist the user in using a fingernail to move that safety catch to the unlatched position.

Figure 13:
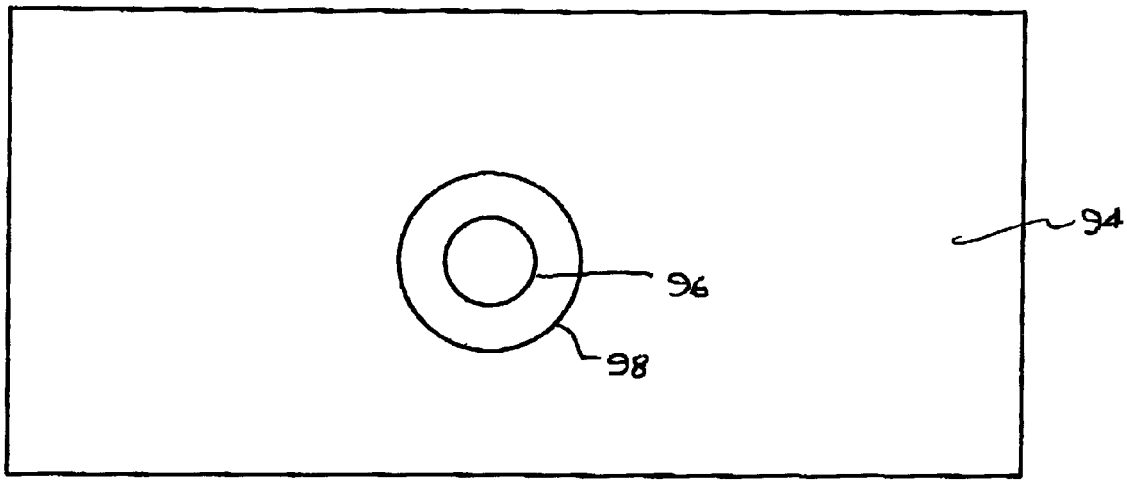
FIG. 13 is a top view of a magnetic means illustrating the preferred means of affixing the magnetic means to a body.
Figure 14:
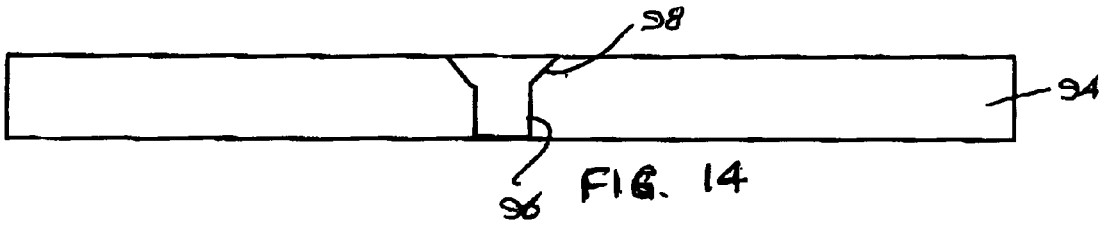
FIG. 14 is a side view of the magnetic means of FIG. 13.

Next, turning to FIGS. 13 and 14, there is shown a top view and a side view of a typical magnet 94 that can be used with the present invention. As can be seen, there is a bore 96 formed in the magnet 94 with a countersink 98. As previously explained, the magnets of the present invention can be affixed to the bodies by means of an adhesive, however, a different technique is utilized for maximum accuracy, uniformity and ease of assembly. The magnets are made with a countersunk hole in the middle of the magnet as illustrated in FIGS. 13 and 14. In the use of bi-polar magnets, however, the countersunk hole is difficult to make in that the magnet may have a thickness in the order of 0.76 mm.

Figure 15:
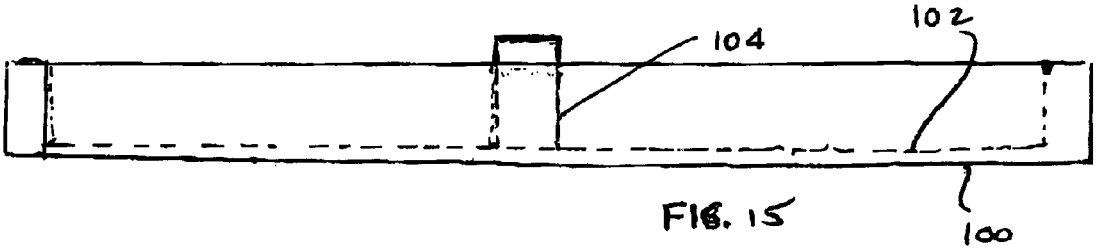
FIG. 15 is a side view of a body that is adapted to have the magnetic means of FIGS. 13 and 14 affixed thereto

In any event, in FIG. 15 there is a body 100 having a recess 102 formed therein for receipt of the magnet 94 and, as can be seen, there is a post 104 that extends upward from the center area of the recess 102. The post 104 is comprised of a soft material and, in the assembly of magnet 94 to the body 100, the magnet 94 is inserted such that the post 104 enters into the bore 96 as the magnet 94 is fully inserted to rest within the recess 102. When installed, the upper end of the post 104 is pressed into the countersink 98 leaving a flat surface on the top of the magnet and fully securing the magnet 94 within the recess 102.

Figure 16:
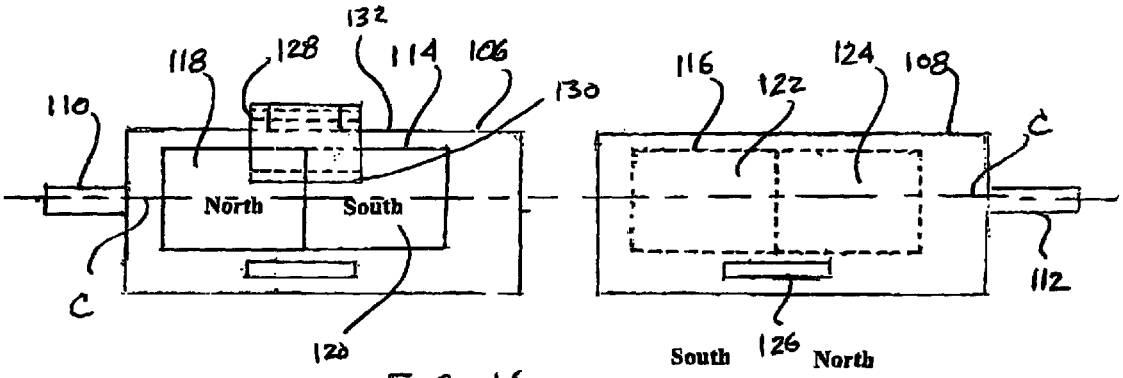
FIG. 16 is a top view of a still further embodiment of the present invention having a side mounted safety catch.

Turning then to FIG. 16, there is shown a top view of yet another embodiment of the present invention. Again, therefore, there is a first body 106 and a second body 108 each having a ring 110, 112 for attachment to the particular chain of the jewelry. In this embodiment there are again used, single multiple polar bar magnets 114, 116 with the bar magnet 114 having a north pole 118 and a south pole 120 and with the bar magnet 116 also having a south pole 122 and a north pole 124 both of which are oriented so that the poles of each bar magnet 114, 116 is on the longitudinal centerline of the first and second bodies 106, 108.

As can be seen, in the alignment of FIG. 16 and in the orientation when the first body 106 and the second body 108 are joined together, the north pole 114 and south pole 116 of the first body 106 will be aligned, respectively, with the south pole 116 and the north pole 118 of the second body 108 such that there will be a magnetic attraction between the respective bar magnets 114, 116 to pull and retain the first and second bodies 106, 108 together. The upper surface of the second body 108 also has an indentation 126 formed therein to serve a purpose to be later described.

Again, as with the prior embodiments, there is a safety catch 128 having a protuberance 130 extending outwardly from the free end thereof at about a right angle. In the view of FIG. 16, the safety catch 128 is shown in its unlatched position and is pivotally affixed to the side 132 of the first body 106, that is, the side remote from the location of the indentation 126 to enable the safety catch 128 to move between its latched position and its unlatched position.

Figure 17:
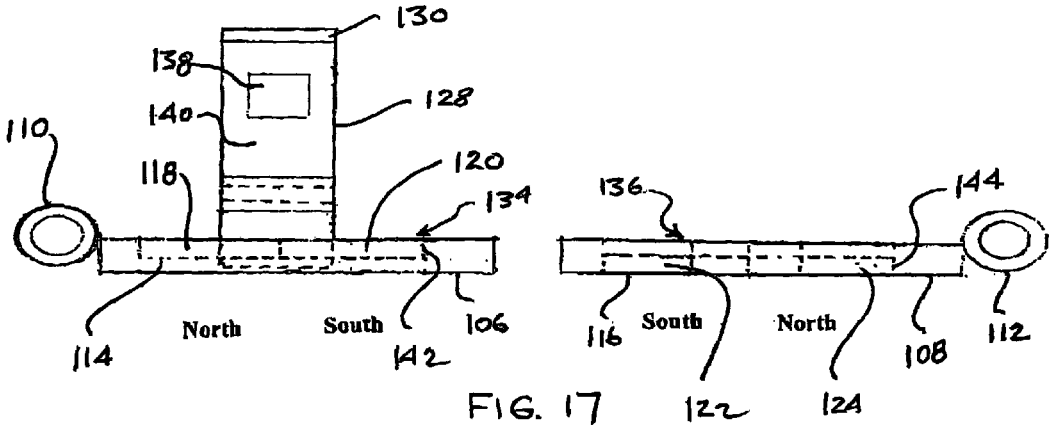
FIG. 17 is a side view of the embodiment of FIG. 16.

Turning now to FIG. 17, there is shown a side view of the clasp of the present invention. In this Fig., it can be seen the bar magnets 114 and 116 form the flat, planar, mating magnetically attractive surfaces 134 and 136, respectively. In addition, there is a metal plate 138 that is affixed to the safety catch 128 along the inner surface 140 of that safety catch 128 that, as will be seen faces the second body 108 when the safety catch 128 is rotated to its latched position. The metal plate 138 is constructed of a magnetically attractive material.

Again, in forming the flat, planar magnetically attractive surfaces, the bar magnets 114, 116 are located with recesses 142, 144 formed, respectively, within the first and second bodies 106, 108 with recesses and, again the poles of the bar magnets 114, 116 are aligned along the longitudinal centerline C of the first and second bodies 106, 108.

Figure 18:
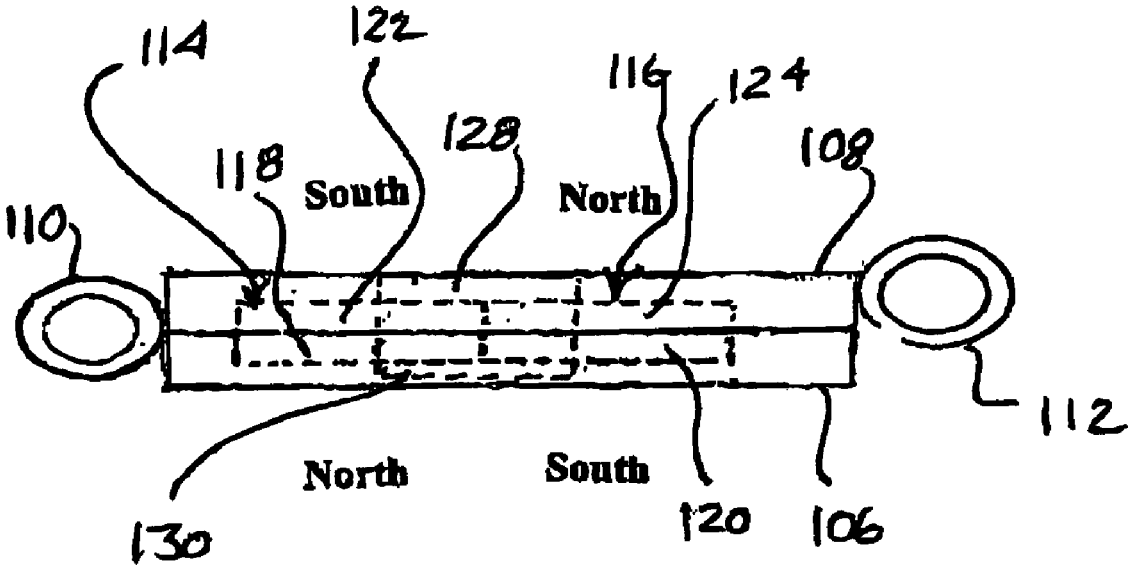
FIG. 18 is a side view of the completed clasp of the FIG. 16 embodiment.

Turning now to FIG. 18, taken along with FIGS. 16 and 17, there is shown a side view of the clasp of the present invention where the safety catch 128 has been moved from its unlatched position of FIGS. 16 and 17 to its latched position.

Therefore, in the final, latched position of the clasp as shown in the side view of FIG. 18, the safety catch, pivotally affixed to the first body 106 has been rotated to it latched position such that the protuberance 130 has entered into and become affixed in the indentation 126 of the second body 108 to retain the first and second bodies 106, 108 firmly together.

As also can be seen in FIG. 18, the bar magnets 114 and 116 have become aligned with each other and the magnetically attractive surfaces 134, 136 are in abutting relationship and are held together by the magnetic attraction of the bar magnets 114, 116 since the north pole 118 of bar magnet 114 is directly abutting and aligned with the south pole 122 of bar magnet 116 and, likewise, the south pole 122 of bar magnet 116 is aligned and contacting the north pole 124 of bar magnet 116, thus, in each instance, the magnetically attractive surfaces 134, 136 are attracted to each other by the mating of the opposite poles of the individual magnets.

In this embodiment, however, the safety catch 128 is held firmly in its latched position by means of the metal plate 138, preferably steel, that is magnetically attracted to the bar magnets 114, 116 and that magnetic attraction holds the safety catch 128 in its latched position of FIG. 18. As an alternative to a plate, the magnetically attractive material can be integral with the safety catch 128 itself. The basic principal of the attraction between the safety catch 128 and the magnetic means is shown and described in U.S. Pat. No. 6,591,462, issued Jul. 15, 2003 to Esther C. Fuhrman and the disclosure of that patent is hereby incorporated herein by reference.

The release of the clasp freeing the first and second bodies 106, 108 is also readily accomplished by simply opening the safety catch 128 by overcoming the magnetic attraction that holds it in the latched position and rotating the safety catch 128 to its unlatched position from its latched position, whereupon the first and second bodies 106, 108 are simply pulled apart from each other in opposite directions, such that the magnetic attraction is readily dissipated, and the first and second bodies 106, 108 easily come apart.

Those skilled in the art will readily recognize numerous adaptations and modifications which can be made to the jewelry clasp and method of joining the same of the present invention which will result in an improved process and clasp, yet all of which will fall within the scope and spirit of the present invention as defined in the following claims. Accordingly, the invention is to be limited only by the following claims and their equivalents.

We claim:

1. A jewelry clasp comprising, a first body having a first magnetic means forming a flat, planar magnetically attractive surface having a north pole and a south pole, a second body having a second magnetic means forming a magnetically attractive surface having a north pole and a south pole, said magnetic means of said first and second bodies being aligned along a longitudinal centerline of the clasp, said magnetically attractive surfaces adapted to be positioned in an abutting relationship with the poles of one of the bodies being aligned with the opposite poles of the other body, a safety catch, said safety catch having one end pivotally mounted to said first body and having a protrusion extending outwardly from the other end, said safety catch being rotatable about the pivotal mounting to a latched position, and an interconnecting element located on the second body, said interconnecting element being a certain distance from an edge of the second body, wherein the protrusion engages the interconnecting element to latch the first and second bodies together, and wherein said first magnetic means comprises separate magnets, with one of said separate magnets having a south pole at said surface and the other of said separate magnets having a north pole at said surface and said second magnetic means comprises separate magnets, with one of said separate magnets having a south pole at said surface and the other of said separate magnets having a north pole at said surface.

2. The jewelry clasp as defined in claim 1 wherein said first and second magnetic means comprises a bipolar bar magnet having a north and a south pole.

3. A jewelry clasp, comprising:

a first body having a first magnetic means forming a flat, planar magnetically attractive surface having a north pole and a south pole, a second body having a second magnetic means forming a magnetically attractive surface having a north pole and a south pole, said magnetic means of said first and second bodies being aligned along a longitudinal centerline of the clasp, said magnetically attractive surfaces adapted to be positioned in an abutting relationship with the poles of one of the bodies being aligned with the opposite poles of the other body, a safety catch, said safety catch having one end pivotally mounted to one of said bodies and having a protrusion extending outwardly from the other end, said safety catch being rotatable about the pivotal mounting to a latched position wherein the protrusion engages the other body to latch the first and second bodies together, wherein said safety catch has a protrusion having an inward lip that overlaps the other body, and wherein said inward lip is located so as to move the other body along a line on which the north and south poles of said first and second magnetic means are located as said safety catch moves to said latched position to misalign said respective north and south poles of said first and second bodies, and said first and second magnetic means causes said first and second bodies to move back to an aligned position when said safety catch reaches said latched position to realign said poles of one of the bodies with the opposites poles of the other body.

4. The jewelry clasp as defined in claim 3 wherein said rapid movement of said first and second bodies produces a click that can be heard and/or felt by a wearer.

5. The jewelry clasp of claim 3 whereby the jewelry clasp is unlatched by laterally pushing the first body and the second body toward each other causing the first and second bodies to misalign thereby separating the first and second bodies and unlatching the safety catch.

6. A jewelry clasp, comprising:

a first body having a first magnetic means forming a flat, planar magnetically attractive surface having a north pole and a south pole, a second body having a second magnetic means forming a magnetically attractive surface having a north pole and a south pole, said magnetic means of said first and second bodies being aligned along a longitudinal centerline of the clasp, said magnetically attractive surfaces adapted to be positioned in an abutting relationship with the poles of one of the bodies being aligned with the opposite poles of the other body, a safety catch, said safety catch having one end pivotally mounted to one of said bodies and having a protrusion extending outwardly from the other end, said safety catch being rotatable about the pivotal mounting to a latched position wherein the protrusion engages the other body to latch the first and second bodies together, wherein said safety catch includes a magnetically attractive material and wherein said safety catch is held in its latched position by a magnetic attraction between said magnetically attractive material and said magnetic means of said first and second bodies.

7. A jewelry clasp comprising, a first body having at least one recess and a first magnetic means with a magnetically attractive surface having a north pole and a south pole located within said at least one recess, said north and south pole being aligned along a longitudinal centerline of the first body, a second body having at least one recess and a second magnetic means with a magnetically attractive surface having a north pole and a south pole located within said at least one recess, said north and south pole being aligned along a longitudinal centerline of the second body, said magnetically attractive surfaces adapted to be positioned in an abutting relationship with the poles of one of the bodies being aligned with the opposite poles of the other body, a safety catch, said safety catch having one end pivotally mounted to one of said bodies and having a protrusion extending outwardly from the other end, said safety catch being rotatable about the pivotal mounting to a latched position wherein the protrusion engages the other body to latch the first and second bodies together, wherein said first body and said second body each have two recesses formed therein and said first and second magnetic means comprises a magnet located in each of said recesses of said first and second bodies, said magnets of said first and second bodies each having a north pole and a south pole at said surface of said first and second bodies.

8. The jewelry clasp as defined in claim 7 wherein said first and said second body each have one recess formed therein and said first and second magnetic means comprises a bipolar bar magnet located in each of said one recess of said first and second bodies, each of said bar magnets having a north pole and a south pole.

9. A jewelry clasp comprising, a first body having at least one recess and a first magnetic means with a magnetically attractive surface having a north pole and a south pole located within said at least one recess, said north and south pole being aligned along a longitudinal centerline of the first body, a second body having at least one recess and a second magnetic means with a magnetically attractive surface having a north pole and a south pole located within said at least one recess, said north and south pole being aligned along a longitudinal centerline of the second body, said magnetically attractive surfaces adapted to be positioned in an abutting relationship with the poles of one of the bodies being aligned with the opposite poles of the other body, a safety catch, said safety catch having one end pivotally mounted to one of said bodies and having a protrusion extending outwardly from the other end, said safety catch being rotatable about the pivotal mounting to a latched position wherein the protrusion engages the other body to latch the first and second bodies together, wherein said first and said second body each have one recess formed therein and said first and second magnetic means comprises a bipolar bar magnet located in each of said one recess of said first and second bodies, each of said bar magnets having a north pole and a south pole, and wherein the at least one recess has an upstanding peg located therein and said bar magnet has a bore with a countersink formed therein and said magnet is affixed within said at least one recess by said post passing through said bore and pressed into said countersink.

10. A jewelry clasp comprising, a first body having at least one recess and a first magnetic means with a magnetically attractive surface having a north pole and a south pole located within said at least one recess, said north and south pole being aligned along a longitudinal centerline of the first body, a second body having at least one recess and a second magnetic means with a magnetically attractive surface having a north pole and a south pole located within said at least one recess, said north and south pole being aligned along a longitudinal centerline of the second body, said magnetically attractive surfaces adapted to be positioned in an abutting relationship with the poles of one of the bodies being aligned with the opposite poles of the other body, a safety catch, said safety catch having one end pivotally mounted to one of said bodies and having a protrusion extending outwardly from the other end, said safety catch being rotatable about the pivotal mounting to a latched position wherein the protrusion engages the other body to latch the first and second bodies together, wherein said at least one recess in said first and second bodies has a post extending upwardly within said at least one recess, and each magnetic means has a countersunk bore formed therein, said magnetic being affixed within said at least one recess by means of said post entering into said countersunk bore wherein said post flattens out within said countersunk bore to affix the first and second magnetic means within said at least one recess.

11. A jewelry clasp comprising, a first body having at least one recess and a first magnetic means with a magnetically attractive surface having a north pole and a south pole located within said at least one recess, said north and south pole being aligned along a longitudinal centerline of the first body, a second body having at least one recess and a second magnetic means with a magnetically attractive surface having a north pole and a south pole located within said at least one recess, said north and south pole being aligned along a longitudinal centerline of the second body, said magnetically attractive surfaces adapted to be positioned in an abutting relationship with the poles of one of the bodies being aligned with the opposite poles of the other body, a safety catch, said safety catch having one end pivotally mounted to one of said bodies and having a protrusion extending outwardly from the other end, said safety catch being rotatable about the pivotal mounting to a latched position wherein the protrusion engages the other body to latch the first and second bodies together, wherein said safety catch has a protrusion having an inward lip that overlaps the other body, and wherein said inward lip is located so as to move the other body along a line extending between the north and south poles of said magnetic means as said safety catch moves to said latched position to misalign said respective north and south poles of said first and second bodies, and said magnetic means causes said first and second bodies to move rapidly back to an aligned position when said safety catch reaches said latched position to realign said poles of one of the bodies with the opposites poles of the other body.

12. The jewelry clasp of claim 11 whereby the jewelry clasp is unlatched by laterally pushing the first body and the second body toward each other causing the first and second bodies to misalign thereby separating the first and second bodies and unlatching the safety catch.

13. A jewelry clasp comprising, a first body having at least one recess and a first magnetic means with a magnetically attractive surface having a north pole and a south pole located within said at least one recess, said north and south pole being aligned along a longitudinal centerline of the first body, a second body having at least one recess and a second magnetic means with a magnetically attractive surface having a north pole and a south pole located within said at least one recess, said north and south pole being aligned along a longitudinal centerline of the second body, said magnetically attractive surfaces adapted to be positioned in an abutting relationship with the poles of one of the bodies being aligned with the opposite poles of the other body, a safety catch, said safety catch having one end pivotally mounted to one of said bodies and having a protrusion extending outwardly from the other end, said safety catch being rotatable about the pivotal mounting to a latched position wherein the protrusion engages the other body to latch the first and second bodies together, wherein said safety catch includes a magnetically attractive material and wherein said safety catch is held in its latched position by a magnetic attraction between said magnetically attractive material and said magnetic means of said first and second bodies.

14. A method of completing the connection of a jewelry clasp, said method comprising the steps of:

providing a first body having a jewelry chain affixed thereto and having a surface with a magnetic means having a south pole and a north pole aligned along a longitudinal centerline of the jewelry clasp, providing a second body having a jewelry chain affixed thereto and having a surface with a magnetic means having a south pole and a north pole aligned along a longitudinal centerline of the jewelry clasp, joining the first and second bodies together by aligning and facing the north and south poles of one of said bodies with, respectively, the south and north poles of the other of said bodies, providing a safety catch affixed to one of the bodies and adapted to be movable to a latched position to engage the other of said bodies when—said bodies are joined together to complete the connection of said first and second bodies together, wherein the step of providing a first body and a second with a magnetic means having a north pole and a south pole comprises providing a first body with a bi-polar bar magnet arid a second body with a bi-polar bar magnet, wherein the step of providing a safety catch comprises providing a safety catch having a protrusion that extends outwardly and engages the other of said bodies, and wherein the step of providing a safety catch comprises providing a safety catch having a lip that displaces the other body along a longitudinal axis extending between the north an south poles to misalign the magnetic means of the first body and the magnetic means of the second body, and allowing the first and second bodies to rapidly move back to the aligned position wherein the opposite poles are aligned when the inwardly directed lip has overlapped the other body in the latched position.

15. The method of claim 14 whereby the jewelry clasp is unlatched by laterally pushing the first body and the second body toward each other causing the first and second bodies to misalign thereby separating the first and second bodies and unlatching the safety catch.

16. A method of completing the connection of a jewelry clasp, said method comprising the steps of:

providing a first body having a jewelry chain affixed thereto and having a surface with a magnetic means having a south pole and a north pole aligned along a longitudinal centerline of the jewelry clasp, providing a second body having a jewelry chain affixed thereto and having a surface with a magnetic means having a south pole and a north pole aligned along a longitudinal centerline of the jewelry clasp, joining the first and second bodies together by aligning and facing the north and south poles of one of said bodies with, respectively, the south and north poles of the other of said bodies, providing a safety catch affixed to one of the bodies and adapted to be movable to a latched position to engage the other of said bodies when—said bodies are joined together to complete the connection of said first and second bodies together, wherein the step of providing a safety catch comprises providing a safety catch having a magnetically attractive material and said safety catch is moved to its latched position wherein the magnetically attractive material of the safety catch is magnetically attracted to the magnetic means of the first and second bodies to retain the safety catch in its latched position.

17. The method of affixing a thin metal magnet to a body having a recess, said method comprising the steps of:

providing a thin metal magnet, forming a bore having a countersunk area in the thin metal magnet;

providing a post comprised of a relatively soft material extending upwardly from the recess to a distal end;

inserting the thin metal magnet into the recess in the body while aligning the post to enter and pass through the bore wherein the distal end of the post is positioned within the countersunk area, and pressing the distal end of the post into the countersunk area to securely affix the thin metal magnet to the body.

18. A jewelry clasp comprising, a first body having a first magnetic means forming a flat, planar, bipolar magnetically attractive surface having a north pole and a south pole on a same side of said surface, a second body having a second magnetic means forming a bipolar magnetically attractive surface having a north pole and a south pole on a same side of said surface, said magnetic means of said first and second bodies being aligned along a longitudinal centerline of the clasp, said magnetically attractive surfaces adapted to be positioned in an abutting relationship with the poles of one of the bodies being aligned with the opposite poles of the other body, a safety catch, said safety catch having one end pivotally mounted to said first body and having a protrusion extending outwardly from the other end, said safety catch being rotatable about the pivotal mounting to a latched position, wherein the protrusion engages the other body to latch the first and second bodies together.

* * * * *